US007891641B1

(12) United States Patent
Miller

(10) Patent No.: US 7,891,641 B1
(45) Date of Patent: Feb. 22, 2011

(54) MANUAL DISENGAGING AND SELF-ENGAGING CLUTCH

(75) Inventor: Jonathan A. Miller, Skiatook, OK (US)

(73) Assignee: Ramsey Winch Company, Tulsa, OK (US)

( * ) Notice: Subject to any disclaimer, the term of this patent is extended or adjusted under 35 U.S.C. 154(b) by 776 days.

(21) Appl. No.: 11/542,094

(22) Filed: Oct. 3, 2006

(51) Int. Cl.
*B66D 1/14* (2006.01)

(52) U.S. Cl. ..... 254/346; 254/344; 254/345; 254/365

(58) Field of Classification Search ..... 254/344, 254/345, 346, 355, 365, 370; 242/261, 262
See application file for complete search history.

(56) References Cited

U.S. PATENT DOCUMENTS

| | | | | | |
|---|---|---|---|---|---|
| 3,319,492 | A | | 5/1967 | Magnuson | |
| 3,744,760 | A | * | 7/1973 | Uher | 254/351 |
| 4,208,036 | A | * | 6/1980 | Huggett et al. | 74/810.1 |
| 4,379,502 | A | | 4/1983 | Ball et al. | |
| 4,396,102 | A | | 8/1983 | Beach | |
| 4,545,567 | A | | 10/1985 | Telford et al. | |
| 4,550,817 | A | | 11/1985 | Euler | |
| 4,775,040 | A | | 10/1988 | Telford | |
| 5,123,630 | A | * | 6/1992 | Watson et al. | 254/346 |
| 5,333,712 | A | * | 8/1994 | Sabee et al. | 192/56.2 |
| 5,374,035 | A | * | 12/1994 | Santos | 254/339 |
| 5,638,935 | A | | 6/1997 | Fehring | |
| 5,791,576 | A | * | 8/1998 | Miyazaki | 242/261 |
| 5,842,684 | A | | 12/1998 | Aho | |
| 5,855,330 | A | * | 1/1999 | Kobayashi | 242/261 |
| 5,927,691 | A | * | 7/1999 | Ottemann | 254/344 |
| 5,967,934 | A | | 10/1999 | Ishida et al. | |
| 6,015,032 | A | | 1/2000 | McGourthy, Jr. et al. | |
| 6,533,056 | B1 | | 3/2003 | Maimone | |
| 6,957,730 | B1 | | 10/2005 | Youngwerth | |

FOREIGN PATENT DOCUMENTS

| | | |
|---|---|---|
| WO | WO 2006/000028 | 1/2006 |

* cited by examiner

*Primary Examiner*—Emmanuel M Marcelo
(74) *Attorney, Agent, or Firm*—Roger N. Chauza, PC

(57) ABSTRACT

A clutch mechanism (75) for use with a machine to disengage the machine until normal operation thereof is commenced. The clutch mechanism (75) includes a clutch engaging member (130) movable into engagement with a notch (77) of the ring gear (76) of a planetary gear stage (70) to engage the clutch, and movable out of engagement with the ring gear (76) to disengage the clutch mechanism (75). The clutch engaging member (130) is spring biased to a position in which the clutch mechanism is engaged. A manually-operated handle (120) moves the clutch engaging member (130) via a link (128) and clutch actuator (122) from a clutch engaging position to a clutch disengaging position. An over-center position of the link (128) and clutch actuator (122) maintains the clutch in a disengaged condition, until normal operation of the machine is commenced, whereupon a protrusion (256) on the clutch actuator (122) is struck and the clutch actuator (122) is forced back to the engaged position, thus self engaging the clutch on commencement of normal machine operation.

7 Claims, 12 Drawing Sheets

5/12
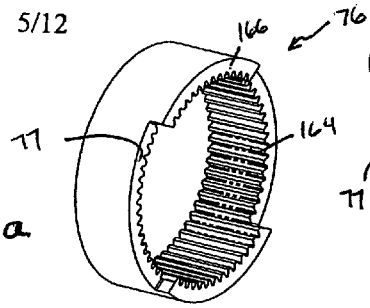
Fig. 6a
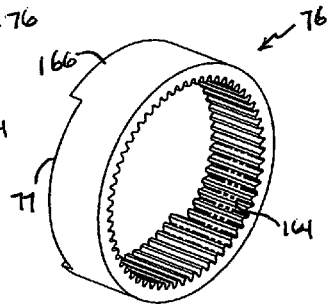
Fig. 6b
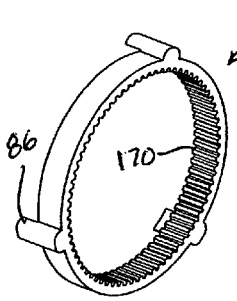
FIG. 7a
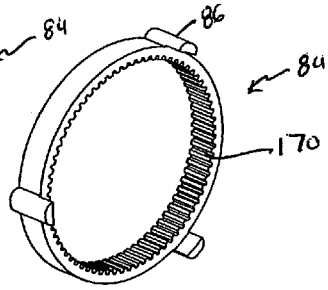
Fig. 7b
Fig. 9b
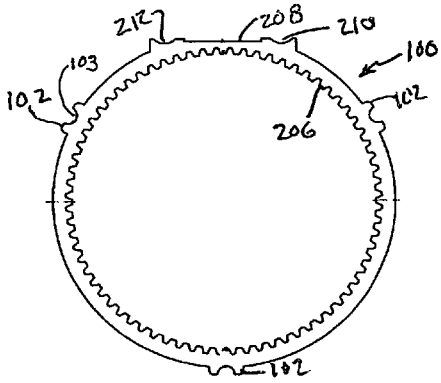
Fig. 9a
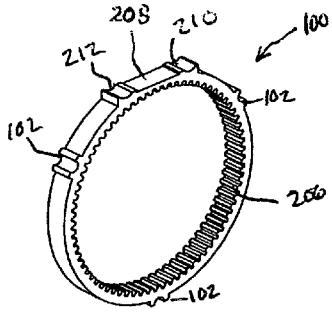

Fig. 11a
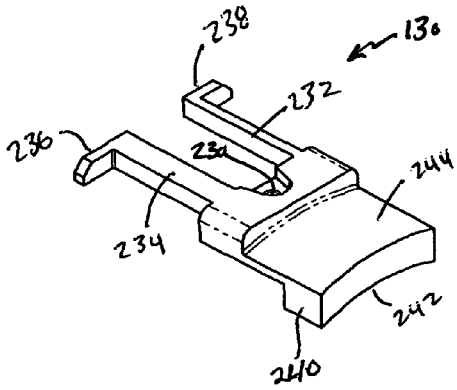
Fig. 11b
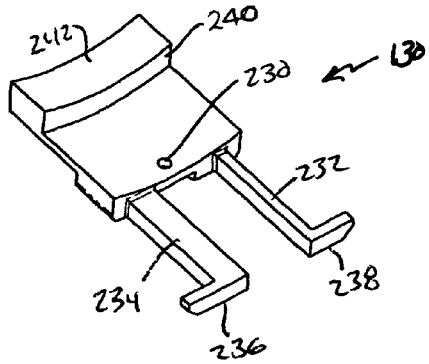
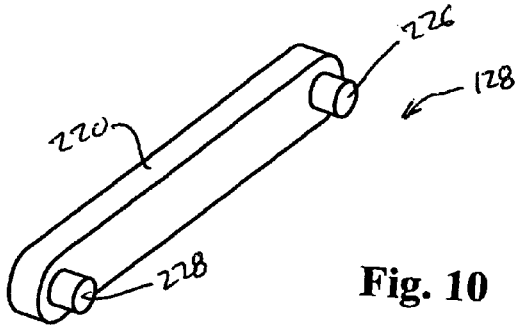
Fig. 10

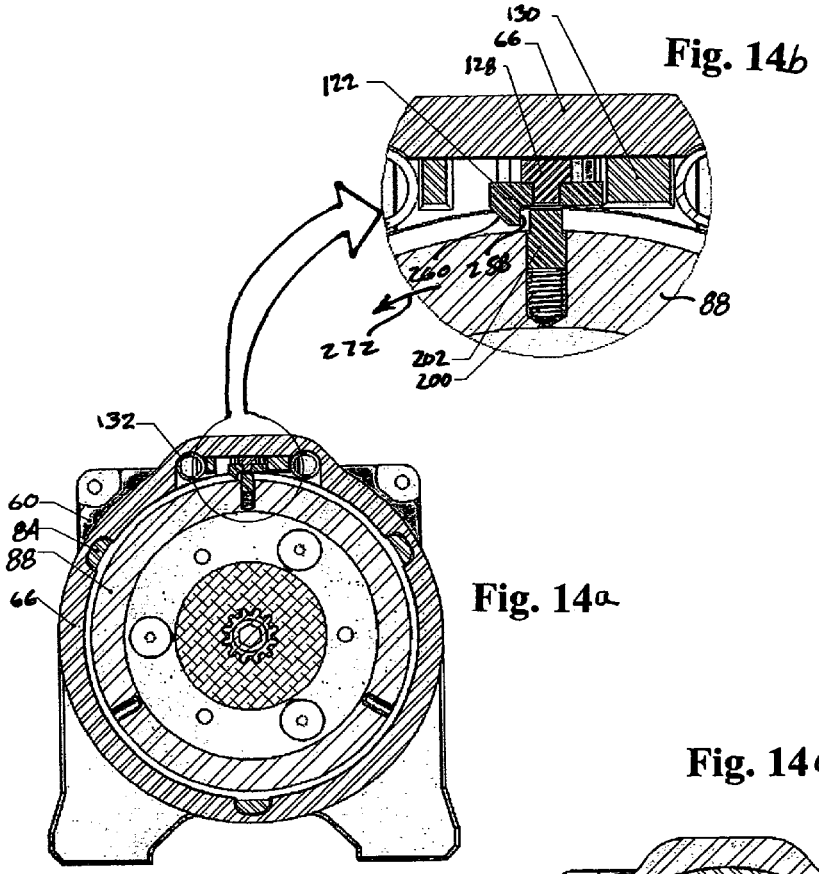
Fig. 14b
Fig. 14a
Fig. 14c
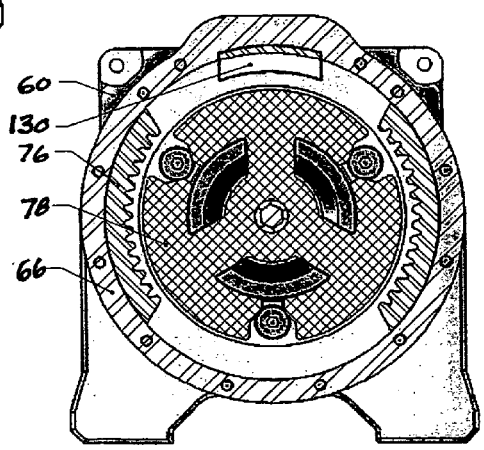

MANUAL DISENGAGING AND SELF-ENGAGING CLUTCH

TECHNICAL FIELD OF THE INVENTION

The present invention relates in general to mechanical clutches, and more particularly to a clutch that can be manually disengaged to allow a machine to free wheel, and automatically or self-engaged upon operation of the machine.

BACKGROUND OF THE INVENTION

Clutches are employed in a host of applications in which a load must be connected or disconnected from a source of power. In automobiles, manual foot-operated clutches are controlled by the driver to connect and disconnect the engine from a transmission. Hydraulic operated clutches are used in automatic transmissions of vehicles to automatically engage and disengage gears and other apparatus for smooth gear shifting operations. Clutches can also be constructed to be engaged electrically, such as many compressors for automobile air conditioners. Various types of small motorcycles, chainsaws and other equipment utilize centrifugal clutches that automatically engage when the RPM of the engine is increased, and disengage when the engine is at idle speed.

U.S. Pat. Nos. 4,379,502 by Ball et al., and 4,396,102 by Beach, both assigned to the assignee hereof, disclose winch clutches of the type that are manually engaged and manually disengaged.

In yet other machines, it is preferable to manually disengage a clutch to allow the driven part to free wheel, and to self engage when the motor or engine is started or the associated drive shaft begins to rotate. Winches are of such types of machines, where the use of a clutch is advantageous to allow loads to be controlled. For example, in a vehicle-mounted winch of the type which is remotely controlled by way of a wireless device, the operator can manually disengage the clutch to allow the cable or rope to be unwound from the drum and connected to an object to be pulled. The operator need not return to the winch to engage the clutch, but need only start the winch with the wireless remote control, whereupon the clutch automatically engages so that the cable is wound on the drum and the object is moved.

From the foregoing, it can be seen that a need exists for a clutch that is constructed so as to be manually disengaged and which self-engages when the drive force is activated.

SUMMARY OF THE INVENTION

In accordance with the principles and concepts of the invention, there is disclosed a machine with a clutch mechanism which is manually disengaged by turning a lever, and which is automatically engaged upon operation of the machine. In a preferred embodiment of the invention, the clutch mechanism is attached to a motor driven winch. The manual operation of the clutch causes the ring gear of a planetary gear reduction stage to become rotatable within a housing, thereby disengaging the cable drum from the motor. This allows the cable to be played out from the free wheeling cable drum. When it is desired to start the motor of the winch, the rotation of the winch apparatus automatically engages the clutch mechanism by locking the ring gear to the housing, thereby causing the cable drum to be driven by the gear reduction stage.

In accordance with one feature of the invention, a clutch lever or handle is coupled to a hinged link so that when manually operated to place the clutch in a disengaged condition, the hinged link is moved to an "over-center" position. The movement of the hinged link moves other components to thereby unlock the ring gear from the housing. The cable drum is thereby disengaged from the gear reduction assembly. When the motor is actuated to wind the cable on the drum, a protrusion on the rotating carrier of the gear reduction assembly moves the hinged link back over center to thereby again lock the ring gear to the clutch housing.

In accordance with another feature of the invention, the hinged link is coupled between a clutch actuator and a locking plunger which is mounted for slideable movement in a clutch housing. The locking plunger is movable into and out of engagement with the ring gear of the planetary gear stage. The ring gear has one or more slots formed therein for engagement with the locking plunger. In one position, the locking plunger is moved into engagement with one of the slots of the ring gear, thus locking the ring gear against rotational movement with respect to the clutch housing. In this position, the hinged link and clutch actuator are forced to a rest position by spring pressure. When the clutch is manually disengaged, the hinged link is moved with the actuator to the over-center position, which action moves the locking plunger out of engagement with the ring gear. The rotation of the winch motor causes the protrusion on the gear reduction assembly to strike the clutch actuator and move it in an opposite direction away from its over-center position to thereby automatically engage the clutch.

In accordance with an embodiment of the invention, disclosed is a self-engaging clutch for use with a winch. The clutch connects a drive member to a driven member, and disconnects the drive member from the driven member of the machine. A clutch engaging assembly has a clutch engaging member that is movable to a first position to cause engagement of the clutch, and movable to a second position to cause disengagement of the clutch. When the clutch engaging member is in the second position, the clutch engaging assembly is responsive to movement of the drive member of the winch to move the clutch engaging member to the first position to thereby self engage the clutch.

In accordance with another embodiment of the invention, disclosed is a clutch for use with a winch of the type having a drum on which a cable is wound and unwound. The clutch includes a drive shaft adapted for powering the winch, a housing in which clutch components are contained, and a clutch mechanism. The clutch mechanism has a locking plunger moveable to a first position for allowing torque to be coupled from the drive shaft to the cable drum and movable to a second position for allowing the cable drum to free wheel. Further included is an actuator manually movable from a rest position in which the clutch mechanism is engaged to an actuated position in which the clutch mechanism is disengaged. The actuator is connected to the locking plunger so that when the actuator is in the rest position the locking plunger allows torque to be coupled to the cable drum, thereby allowing the drive shaft to drive the cable drum, and when the actuator is moved to the actuated position the cable drum is disconnected from the drive shaft and can be free wheeled. A striking member is rotatable by the drive shaft, where the striking member is engageable with the actuator to move the actuator from the actuated position to the rest position to thereby automatically engage the clutch mechanism when the drive shaft is rotated.

With regard to yet another embodiment of the invention, disclosed is a clutch for use with a winch of the type having a drum on which a cable is wound and unwound. The winch includes a housing for housing the clutch, an input shaft driven by a motor and a cable drum. At least one planetary gear stage couples torque from the input shaft to the cable drum, where the planetary gear stage has a sun gear, plural planetary gears and a carrier for supporting the planetary gears. A ring gear is mounted for rotation, and the planetary gears mesh with the ring gear. A clutch mechanism couples torque from said planetary gear stage to the cable drum and disconnects the planetary gear stage from the cable drum. The clutch mechanism includes an actuator having a shaft connected to a handle, where the actuator is manually operable from a rest position to a second position for disengaging the clutch. The actuator has a lug located off center from an axis of said handle shaft. The clutch mechanism further includes a locking member adapted for movement into engagement with the ring gear to lock the ring gear with respect to the housing, and out of engagement with the ring gear to allow the ring gear to rotate with the planetary gear stage. Included is a hinged link connecting the actuator to the locking member. The link and the actuator are movable to an over-center condition when the actuator is in the second position. A rotating member is rotatable when the motor is energized. The rotating member is adapted for striking the actuator lug to rotate the actuator and move the locking member into engagement with the ring gear.

In accordance with a method of self engaging a clutch used with a winch, disclosed are the steps of driving a cable drum using a planetary gear system, and manually disengaging the clutch by moving a handle from a first position to a second position. Another step includes causing movement of the handle from the first position to the second position to move a clutch engaging member out of engagement with a ring gear of the planetary gear system to thereby allow the ring gear to rotate and thus to disengage drive to the cable drum, whereby cable can be manually played out from the drum without driving the cable drum. In response to an application of a drive to the cable drum in a direction to wind cable thereon, the clutch engaging member is caused to move into engagement with the ring gear to prevent rotation thereof and thus self engage said clutch and allow cable to be wound on the cable drum.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which:

FIGS. 6*a* and 6*b* are isometric views of the output ring gear of the invention;

FIGS. 7*a* and 7*b* are isometric views of the intermediate ring gear of the invention;

FIGS. 9*a* and 9*b* are respective isometric and end views of the input ring gear constructed according to the invention;

FIG. 10 is an isometric view of the link constructed according to an embodiment of the invention;

FIGS. 11*a* and 11*b* are respective top and bottom isometric views of the locking plunger constructed according to an embodiment of the invention;

FIG. 14*a* is a cross-sectional view of the clutch mechanism, taken through the engaging plate of the intermediate gear carrier;

FIG. 14*b* is an enlarged view of a portion of the clutch mechanism shown in FIG. 14*a;*

FIG. 14*c* is a cross-sectional view of the clutch mechanism, taken through the output gear carrier assembly;

DETAILED DESCRIPTION OF THE INVENTION

Figure 1:
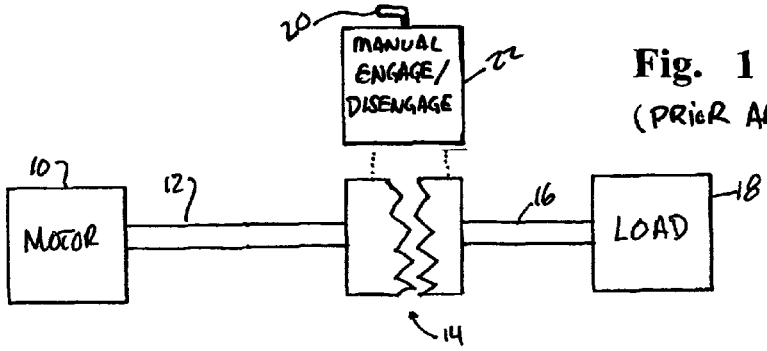
Fig. 1 (PRIOR ART)
FIG. 1 illustrates a conventional manually disengaged and manually engaged clutch.

FIG. 1 illustrates in simplified form a prior art clutch 14 employed to connect and disconnect a load 18 from a driving force, such as a motor 10. The clutch 14 is situated between the load 18 and the motor 10, and includes a mechanism, such as engaging teeth, for connecting a drive shaft 12 (connected to the motor 10) to a driven shaft 16 (connected to the load 18). The clutch parts are separated and thus disengaged upon manual operation of a lever 20. The manual engage/disengage mechanism 22 can be any of many different forms of linkages, components and parts to accomplish this function. When it is desired to again engage the clutch to connect the motor 10 to the load 18, the lever 20 is moved back to its original position, thereby allowing the mechanism 22 to reconnect the parts of the clutch together. This manually operated clutch requires the operator to be physically at the machine to both disengage and engage the clutch manually.

Figure 2:
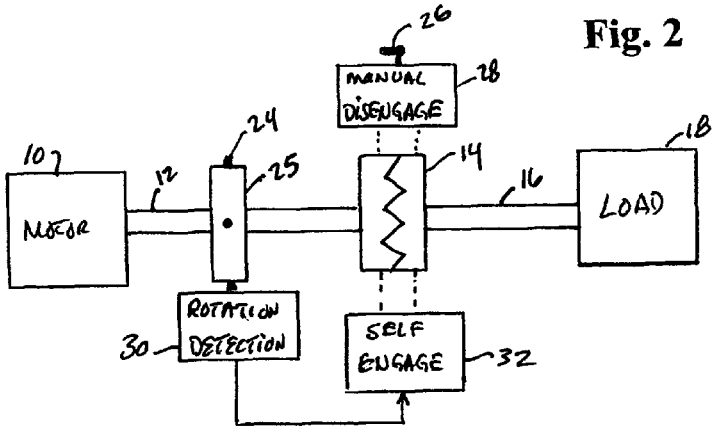
FIG. 2 is a simplified drawing of a machine equipped with various features of the invention, showing a clutch that is manually disengaged and self engaging upon operation of the drive force.

With reference to FIG. 2, there is shown in simplified form the principles and concepts of the invention. FIG. 2 illustrates a motorized mechanism adapted for many uses. The mechanism includes a drive motor 10, which may be an AC, DC or hydraulic motor that operates in one or both directions of rotation. The motor 10 is coupled by a drive shaft 12 to a clutch mechanism 14. The clutch mechanism 14 may include many different types of clutches, including friction clutches, jaw clutches, magnetic clutches, etc. Attached to the output of the clutch 14 is a load shaft 16 connected to a load 18.

In the illustration the clutch 14 is constructed with components that are axially slidable on the drive shaft 12 in one direction to disengage the clutch 14 and in the other direction to engage the clutch 14.

Attached to the drive shaft 12 and rotatable therewith is a disk 25 or other rotating member having one or more spring-loaded pins or fixed pins, one shown as numeral 24. The pins may be rod shaped, rectangular in shape, or with a cam edge and an abrupt edge. The pin 24 can be radially slidable in a hole formed in the disk 25, and is biased outwardly by a spring. The pin 24 can be captured in the disk 25 in any of many different ways, all apparent to those skilled in the art. Rather than using a rotating disk 25, the pins can be mounted to any part that rotates when the motor is activated.

The disengagement of the clutch 14 is controlled by a manually-operated lever or handle 26. Preferably, the handle 26 is rotated to disengage the clutch 14 so that the driven shaft 16 can be disconnected from the motor 10. In accordance with an important feature of the invention, the clutch 14 is self-engaged when the motor 10 commences operation. The handle 26 is coupled to a manual disengage assembly 28 which, in turn, is connected to the clutch 14. When the handle 26 is moved from the rest position, the manual disengage assembly 28 disengages the clutch 14. In the type of clutch shown in FIG. 2, the clutch teeth are forced apart during disengagement to thereby disconnect the drive train. In a friction-type clutch, the friction plates are forced apart. In other types of clutches, the clutch parts are moved to positions where the clutch is disengaged.

The clutch 14 of the invention can be automatically engaged upon operation of the motor 10, i.e., when the drive shaft 12 is rotated. In this event, the disk 25 is also rotated. The rotation of the disk 25, or other apparatus connected to the shaft of the motor 10, moves the pin or pins 24 in the proximity of a rotation detection device 30. The rotation detection device 30 detects the commencement of operation of the motor 10. In the preferred embodiment of the invention, the rotation detection device 30 is a member that is struck by the pin or pins 24. The rotation detection device 30 is coupled to or includes a self engaging device 32 which automatically engages the clutch 14 on the detection of operation of the motor 10. In the preferred embodiment, the self engage device 32 includes a locking plunger that is engaged with a ring gear of a planetary gear stage to thereby allow the drive force to be coupled to the cable drum of a winch. In the disengaged condition of the winch, the ring gear is allowed to turn, thereby disconnecting the cable drum from the motor drive mechanism. As noted, the ring gear is locked and prevented from rotation when the clutch is engaged. While the principles of the clutch are shown in simplified form in FIG. 2, many other variations are possible, all of which are possible from the adaption of the teachings hereof.

Figure 3:
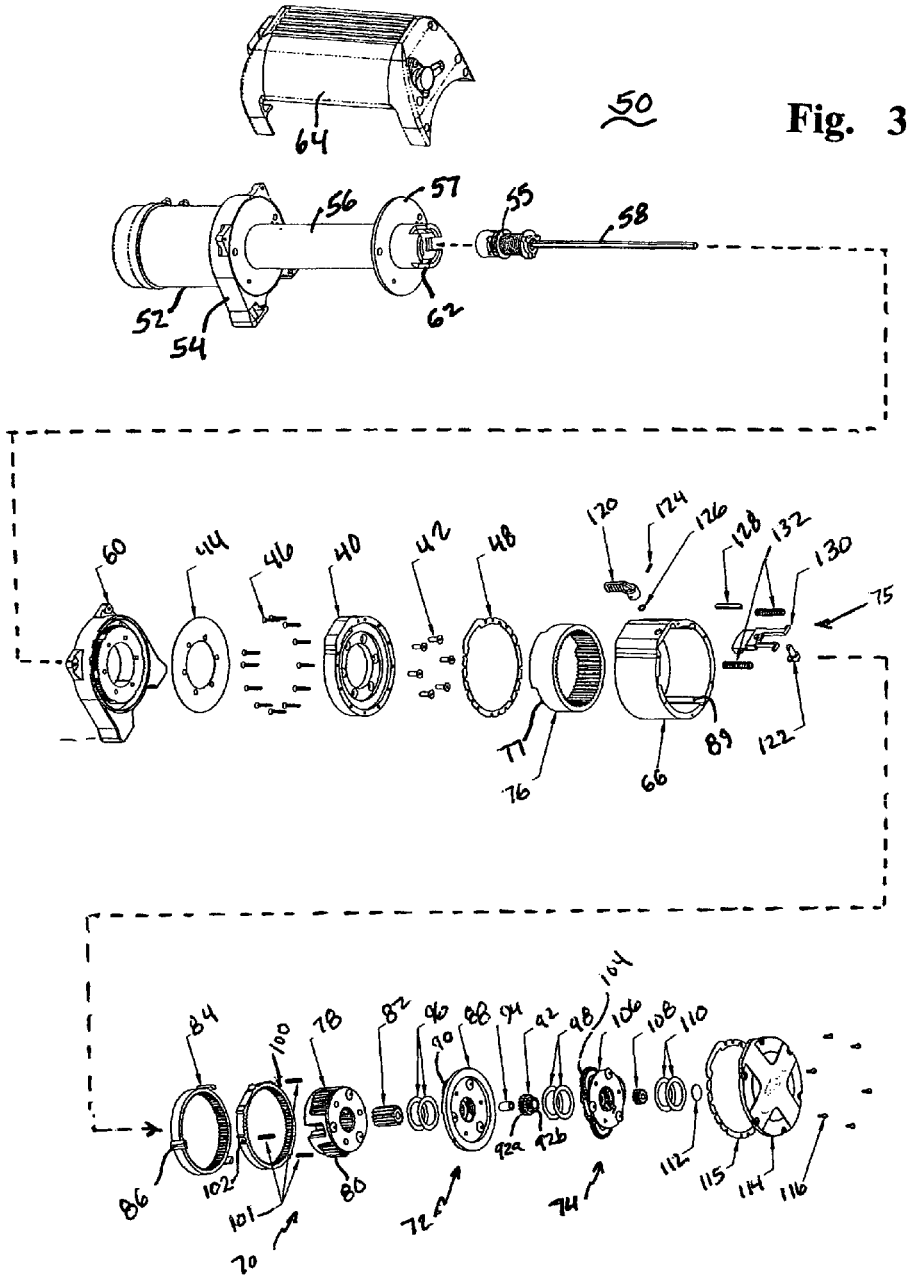
FIG. 3 is an exploded view showing the components of a winch adapted for use with the clutch mechanism of a preferred embodiment of the invention.

With reference now to FIG. 3 of the drawings, there is illustrated an exploded view of the details of the clutch mechanism 75 constructed according to a preferred embodiment of the invention. The clutch mechanism 75 is adapted for use with a winch 50 of the type mounted to a vehicle. As such, the winch 50 includes a DC motor 52 attached to a motor end bearing 54. A cable drum 56 is mounted for rotation in the motor end bearing 54. A hex-shaped input shaft 58 is coupled to a brake assembly 55 and is driven by the motor 52. The brake assembly 55 is mounted to the input shaft 58 and located inside the cable drum 56 so that when activated, a braking force is applied to the inside surface of the cable drum 56. The cable drum 56 is mounted for rotation in an opposing end bearing 60. The end bearings 54 and 60 are held in a spaced-apart manner by a rigid shell 64. Bolts are employed to fasten the end bearings 54 and 60 to the shell 64. The shell 64 also functions to house electrical solenoids for controlling the direction of DC current carried through the motor 52. The hub of the cable drum 56 shown in FIG. 3 has notches or slots 62 for mating with corresponding lugs on the output planetary gear carrier, to be described in more detail below. Accordingly, the motor 52 drives a three-stage planetary gear assembly which, in turn, drives the cable drum 56 at a reduced rotational speed.

An output gear housing 40 is bolted to the end bearing 60 by cap screws 42. A gasket 44 provides a seal between the output gear housing 40 and the end bearing 60. Another set of cap screws 46 fasten a main gear housing 66 to the output gear housing 40. Again, a gasket 48 provides a seal between the main gear housing 66 and the output gear housing 40.

The main gear housing 66 houses the planetary gear assembly and the clutch mechanism. In the preferred embodiment of the invention, the planetary gear assembly includes an output planetary gear stage 70, an intermediate planetary gear stage 72 and an input planetary gear stage 74. The planetary gear stages 70, 72 and 74 each function to provide an additional reduction of the motor speed so that the cable drum 56 rotates at an RPM much lower than the shaft of the motor 52. Various components of the clutch mechanism are shown generally as numeral 75.

The output planetary gear stage 70 includes a ring gear 76 adapted for being fixed, or rotatable, as a function of whether the clutch mechanism 75 is engaged or disengaged. The output ring gear 76 includes one or more notches 77 formed in an annular edge thereof for engagement with the clutch mechanism 75. The output planetary gear stage 70 further includes a gear carrier 78 with three planetary gears 80 rotatably mounted thereto. An elongate sun gear 82 not only engages with the three planetary gears 80, but also engages with the internal gear teeth (not shown) formed in the end of the gear carrier 178 (FIG. 8) of the intermediate planetary gear stage 72.

The intermediate planetary gear stage 72 includes a ring gear 84 with three guide lugs 86 slidable into the respective slots 89 of the main gear housing 66. The guide lugs 86 also function to maintain a lateral spacing between the intermediate ring gear 84 and the input ring gear 100 which allows the engaging plate 88 room to rotate. The intermediate ring gear 84 is thus fixed and not rotatable. Three springs 101 extend through respective pair of grooved guide bars 102 (FIG. 9) formed on the periphery of the input ring gear 100. The springs 101 abut against the inside surface of the gear housing cover 114 and urge the intermediate ring gear 84 against the output ring gear 76. This causes a small drag on the cable drum 56 so that the drum 56 cannot be rotated faster than the cable is played out by the winch operator.

The intermediate planetary gear stage 72 further includes a gear carrier 178 and three planetary gears 90. To be described in more detail below, the engaging plate 88 holds one or more spring-loaded plungers mounted in the annular edge thereof. A dual sun gear 92, comprising a larger gear **92*a* and a smaller gear 92*b*, is engageable with the planetary gears 90 of the intermediate planetary gear stage 72. A bushing 94 with a hex bore is insertable into the bore of the dual sun gear 92. A pair of thrust washers 96 are shown placed between the output planetary gear stage 70 and the intermediate planetary gear stage 72. Similarly, a pair of thrust washers 98 are placed between the intermediate planetary gear stage 72 and the input planetary gear stage 74**.

The input planetary gear stage 74 includes a ring gear 100 with three grooved guide bars 102. As noted above, the groove in the guide bars 102 accommodates a respective spring 101. The guide bars 102 also engage within the slots 89 of the main gear housing 66. The input ring gear 100 is thus fixed against rotation. A set of planetary gears 104 is rotatably mounted in a carrier 106. A sun gear 108 meshes with the planetary gears 104 in a conventional manner. The sun gear 108 of the input planetary gear stage 74 has a hex bore and is driven by the hex input shaft 58. A pair of thrust washers 110 and a thrust disc 112 are placed between the input planetary gear stage 74 and a gear housing cover 114. A gasket 115 is placed between the gear housing cover 114 and the main gear housing 66. A number of cap screws 116 are used to fasten the gear housing cover 114 and the gasket 115 to the end of the main gear housing 66 to provide an enclosure to the planetary gear assembly and the clutch mechanism 75.

It can be seen from the foregoing that the hex input shaft 58 extends through the cable drum 56, through the output and intermediate planetary gear stages 70 and 72. In the normal operation of the winch 50 when the clutch mechanism 75 is engaged, the hex input shaft 58 (driven by the motor 52) drives the input planetary gear stage 74. The carrier 106 of the input planetary gear stage 74 then drives the smaller sun gear 92*b* of the intermediate planetary gear stage 72. The gear carrier 178 of the intermediate planetary stage 72 drives the sun gear 82 of the output planetary gear stage 70. The slots 62 of the cable drum 56 engage with a corresponding lugs (not shown) mounted to the gear carrier 78 of the output planetary gear stage 70.

In accordance with an important feature of the invention, the winch 50 includes a clutch mechanism 75 that can be manually disengaged, but is self engaging when the motor 52 is energized. In the context of the invention, the clutch is engaged when rotation of the motor shaft causes corresponding rotation of the cable drum 56, and disengaged when the cable drum 56 can be rotated without rotation of motor shaft. The clutch mechanism 75 includes a manually-operated lever or handle 120 connected to an actuator 122 by a pin 124. An O-ring 126 is used as a seal around the shaft of the actuator 122. The actuator 122 is connected to a link 128 which, in turn, is connected to a locking plunger 130. The locking plunger 130 is spring biased against the main gear housing 66 by a pair of coil springs 132. The locking plunger 130 is adapted for engaging within the notch 77 formed in the output ring gear 76 when the clutch mechanism 75 is engaged.

Figure 4C:
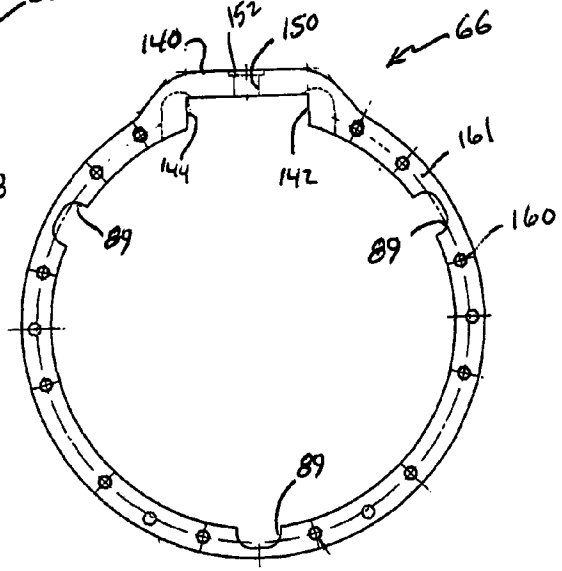
FIG. 4*c* is a left end view of the main gear housing constructed according to the invention.
Figure 4B:
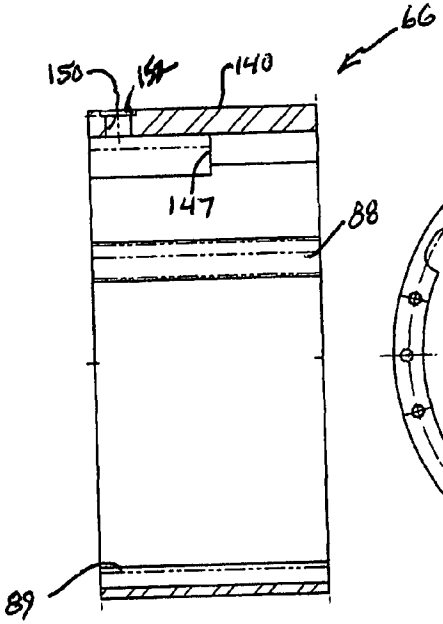
FIG. 4*b* is a cross-sectional view of the main gear housing taken along line 4*b*-4*b* of FIG. 4*a*.
Figure 4A:
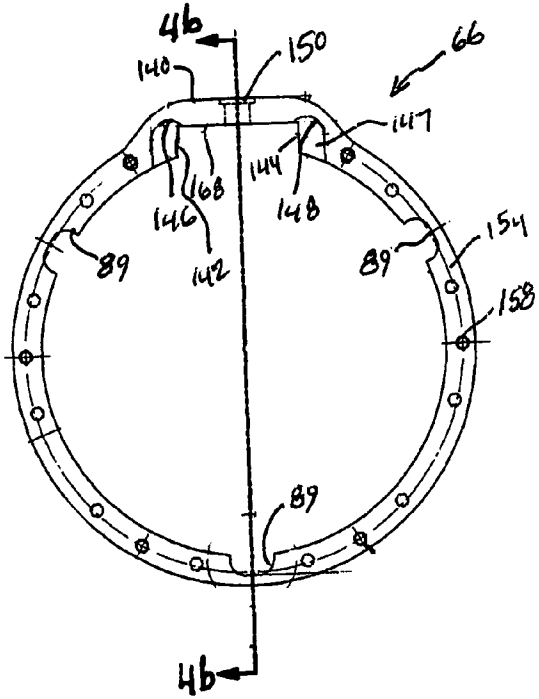
FIG. 4*a* is a right end view of the main gear housing.

Set forth below is a more detailed description of the structure and function of the preferred embodiment of the invention. FIGS. 4*a-c* illustrate the details of the main gear housing 66, which is constructed using powder metal processing techniques. The main gear housing 66 is constructed generally in a barrel shape, but with a top protrusion 140 to accommodate the components of the clutch mechanism 75. The main gear housing 66 is constructed with a pair of small internal vertical sidewalls 142 and 144 to register and support therebetween the locking plunger 130, as shown in FIGS. 11*a* and 11*b*. Hollowed out areas 146 and 148 are formed in the top protrusion 140 of the main gear housing 66 to house the springs 132. The respective ends 147 of the hollowed out areas 146 and 148 form stops against which the springs 132 abut. A bore 150 is formed in the top protrusion 140 to receive therein the shaft portion of the actuator 122. At the surface of the bore 150 there is formed a recessed area 152 for receiving therein the O-ring 126 to provide a seal. Three slots 89 are formed equidistant from each other in the internal wall of the main gear housing 66. As noted above, the slots 89 receive the lugs 86 of the intermediate ring gear 84 and the grooved guide bars 102 of the input ring gear 100 to prevent rotation of such ring gears. Threaded holes 158 are formed in the annular edge 154 for bolting the end cover 114 to the main gear housing 66. Threaded holes 160 are formed in the other annular edge 161 of the main gear housing 66 for fastening the output gear housing 40 thereto.

Figure 5C:
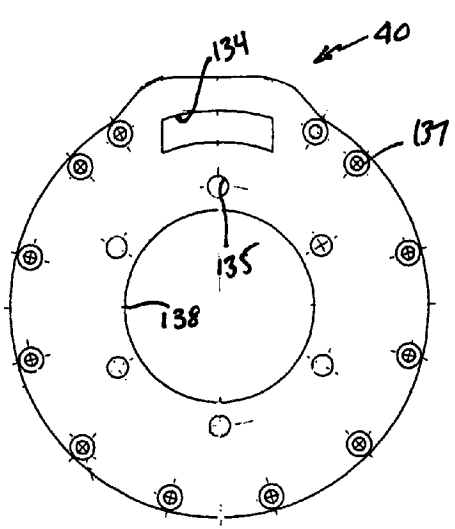
FIGS. 5*a*-5*c* are respective right end, cross-sectional and left end views of the output gear housing of the invention.
Figure 5B:
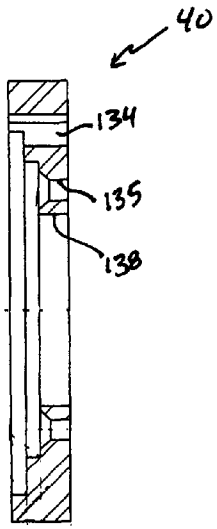
Figure 5A:
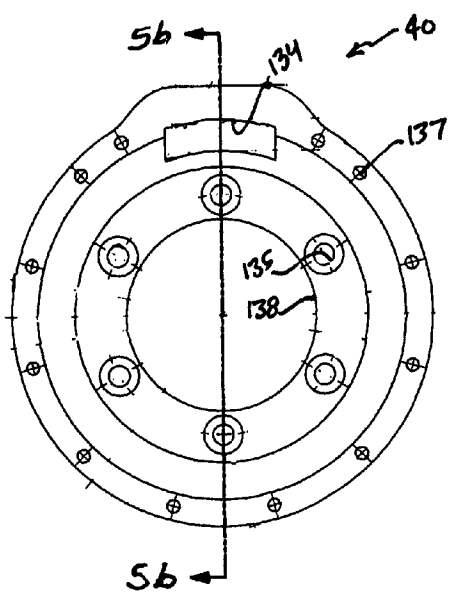

FIGS. 5*a*-5*c* illustrate the structural details of the output gear housing 40. The output gear housing 40 is effectively an extension of the main gear housing 66 for allowing efficient assembly and construction of the winch components. The output gear housing 40 and the main gear housing are each constructed using powder metal technology. During assembly, the output gear housing 40 is first bolted to the main gear housing 66, and then the output gear housing 40 (with main gear housing 66 attached thereto) is bolted to the winch end bearing 60.

The output gear housing 40 has an exterior shape the same as the main gear housing 66. A lateral slot 134 is formed in the output gear housing for receiving and supporting therein the block 240 (FIG. 11*a*) of the locking plunger 130. A number of counter sunk holes 135 are formed in the output gear housing 40 for bolting it to the end bearing 60. Another set of countersunk holes 137 are formed in the output gear housing 40 for bolting it to the main gear housing 66. A central opening 138 in the output gear housing 40 accommodates a portion of the output carrier 78 of the output planetary gear stage 70 therein, as well as a portion of the lugs/slots 62 on the hub of the cable drum 56.

With reference now to FIGS. 6*a* and 6*b*, there is illustrated the output ring gear 76 constructed in accordance with the invention. The output ring gear 76 has formed on the inner surface thereof teeth 164 which mesh with the teeth of the three planetary gears 80 of the output planetary gear stage 70. It is noted that the output ring gear 76 does not include lugs that engage with the slots 89 of the main gear housing 66. One annular edge 166 of the output ring gear 76 has formed therein two recessed notches, one shown as numeral 77. The lateral depth of each notch 77 is about a third of an inch. The block 240 of the locking plunger 130 is axially slidable into and out of the notch 77 of the output ring gear 76. The respective disengagement and engagement of the block 240 of the locking plunger 130 in the output ring gear 76 allows the output ring gear 76 to rotate with the output planetary gear stage 70, or arrests rotational movement thereof while the output gear carrier 78 of the output planetary gear stage 70 rotates. It can be seen that the axial travel of the locking plunger 130 is very slight in order to control the rotational movement of the output ring gear 76.

FIGS. 7*a* and 7*b* illustrate the construction of the intermediate ring gear 84. The intermediate ring gear has teeth 170 that mesh with the teeth of the planetary gears 90 of the intermediate planetary gear stage 72. Formed on the outer periphery of the intermediate ring gear 84 are three lugs 86 for engaging in the slots 89 formed within the main gear housing 66. This engagement prevents rotation of the intermediate ring gear 84.

Figure 8:
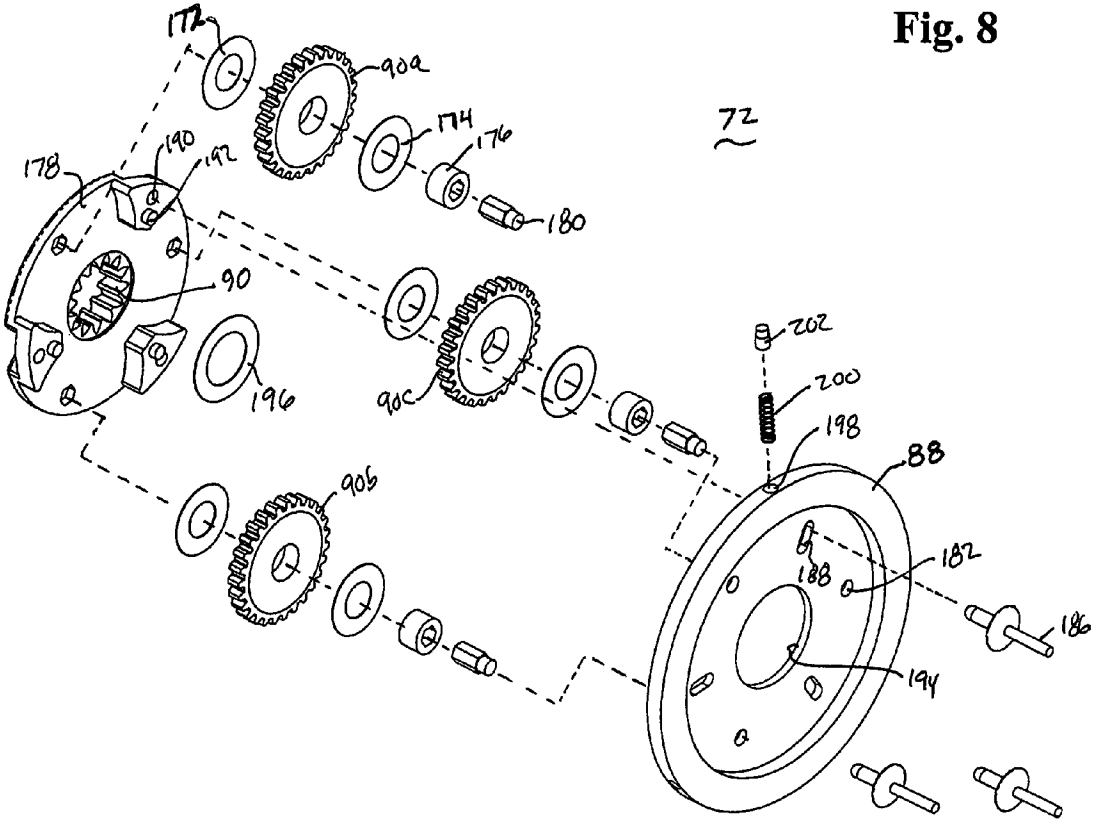
FIG. 8 is an exploded view of the intermediate planetary gear stage constructed according to the invention.
Figure 12A:
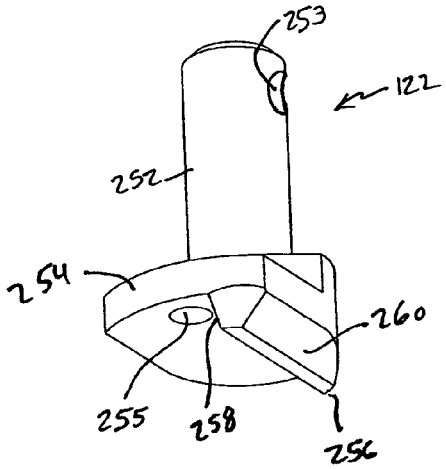
FIGS. 12*a* and 12*b* are respective isometric views of the actuator constructed according to an embodiment of the invention.
Figure 12B:
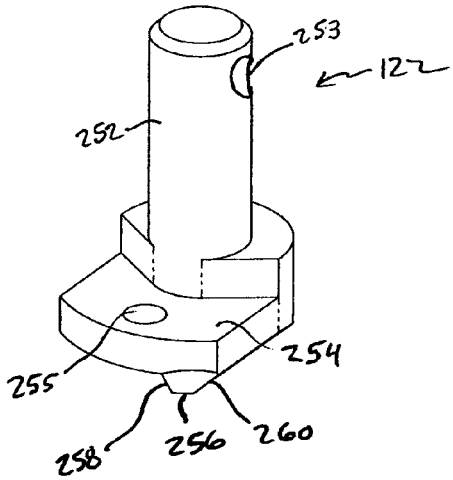
Figure 12C:
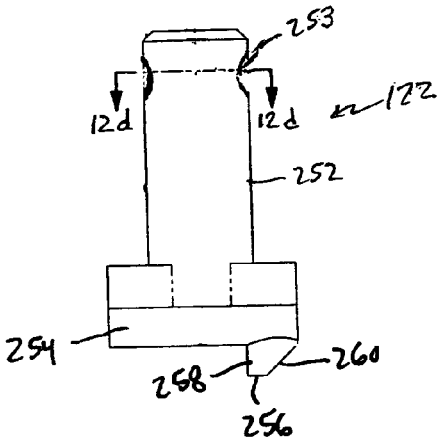
FIG. 12*c* is a side view of the actuator.
Figure 12D:
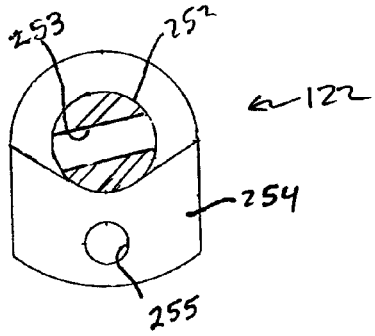
FIG. 12*d* is a cross-sectional view of the actuator, taken along line 12*d*-12*d* of FIG. 12*c;*

FIG. 8 illustrates the components of the intermediate planetary gear stage 72 constructed according to the preferred embodiment of the invention. Planet gear 90*a* is associated with thrust washers 172 and 174. A bushing 176 provides a bearing for the planetary gear 90*a*. The planet gear 90*a* is fixed to a gear carrier 178 by a pin 180. The hex part of the pin 180 fits into a hex hole in the gear carrier 178. The hex hole has a bottom so that the pin 180 abuts against such bottom. The round part of the pin 180 fits in the hole 182 of the engaging plate 88 of the intermediate planetary gear stage 72. The other two planet gears 90*b* and 90*c* are mounted for rotation to the gear carrier 178 in the same manner. The engaging plate 88 is attached to the gear carrier 178 by three blind rivets, one shown as numeral 186. The blind rivet 186 extends through a top portion of the slot 188 formed in the engaging plate 88, and through a hole 190 formed in the gear carrier 178. A pin 192 formed on the gear carrier 178 extends through a bottom portion of the slot 188 of the engaging plate 88.

Cast with the gear carrier 178 are internal teeth 90. The teeth 90 of the gear carrier 178 engage with the gear teeth of the output sun gear 82, as shown in FIG. 3. The large-diameter gear 92*a* of the sun gear 92 (FIG. 3) can be inserted through the opening 194 of the engaging plate 88 and into engagement with the teeth of the three planet gears 90*a*, 90*b* and 90*c*. A thrust washer 196 is placed between the gear carrier 178 and the face of the intermediate sun gear 92.

Three bores 198 are formed radially in the circumferential edge of the engaging plate 88, as shown in FIG. 8. A coil spring 200 is inserted into the bore 198, together with a plunger pin 202. The plunger pin 202 has a larger diameter end which is located below the surface of the circumferential edge of the engaging plate 88. The plunger pin 202 is captured in the bore 198 by swaging or mushrooming the opening of the bore 198, or by other suitable means. The other two bores 198 formed in the engaging plate 88 are empty, but either or both could have spring loaded pins installed therein in the same manner described above.

FIGS. 9*a* and 9*b* illustrate the details of the input ring gear 100 of the input planetary gear stage 74. The input ring gear 100 includes internal teeth 206 for meshing with the planet gears 104 of the input planetary gear stage 74. Much like the intermediate ring gear 84, the input ring gear 100 has formed on the periphery thereof three grooved guide bars 102 for engaging with the respective slots 89 of the main gear housing 66. Formed on the top surface of the input ring gear 100 is a flat surface 208 upon which the bottom of the clutch actuator 122 rests. On each side of the flat surface 208 there are formed concave areas 210 and 212 for accommodating the springs 132 of the clutch mechanism 75. As can be appreciated, the input ring gear 100 is inserted into the main gear housing 66 with the grooved guide bars 102 engaging within the respective slots 89. The input ring gear 100 is thus held against rotation. The springs 101 (FIG. 3) providing drag to the cable drum 56 protrude through the grooves 103 of the grooved guide bars 102.

Shown in FIG. 10 is a link 128 constructed to connect the clutch actuator 122 (FIGS. 12*a*-12*d*) to the locking plunger 130 (FIGS. 11*a* and 11*b*). The link 128 provides the over-center action with the clutch actuator 122 when the clutch mechanism 75 is disengaged. The link 128 is an straight section of metal with pins 226 and 228 formed near the opposite ends thereof. The pin 226 fits within a hole 230 (FIG. 11*b*) of the locking plunger 130. The pin 228 of the link 128 fits into the hole 255 of the clutch actuator 122 shown in FIGS. 12*a*-12*d*.

The detailed construction of the locking plunger 130 is shown in FIGS. 11*a* and 11*b*. The locking plunger 130 has a part that is fork-shaped with bifurcated legs 232 and 234. The leg 234 is wider than the leg 232. Each leg 232 and 234 includes outwardly turned ends 236 and 238. As will be described in more detail below, the out-turned ends 236 and 238 engage with respective springs 132. As noted above, the hole 230 receives therein a pin 226 of the link (FIG. 10). Thus, as the link 128 is moved laterally by the clutch actuator 122, the locking plunger 130 moves accordingly.

Formed at the other end of the locking plunger 130 is a downwardly depending block 240. It is the block 240 that is shifted laterally to engage with the notches 77 of the output ring gear 76. The undersurface 242 of the block 240 is curved. The top 244 of the block 240 is curved to fit into the output gear housing 40. When the locking plunger 130 is shifted, the block 240 moves into and out of engagement with the notch 77 of the output ring gear 76. The edges of the block 240 can be beveled to facilitate engagement with the notches 77 of the output ring gear 76.

FIGS. 12*a*-12*d* illustrate the detailed construction of the clutch actuator 122. The clutch actuator 122 includes a shaft 252 that extends through an opening 150 in the main gear housing 66, and is attached to the handle 120. The shaft 252 has formed therein a lateral bore 253 through which a split pin 124 is inserted to fasten the handle 120 thereto. When the handle 120 is rotated, for example ninety degrees to disengage the clutch mechanism 75, the clutch actuator 122 is rotated, which in turn shifts the link 128 longitudinally, and thus moves the block 240 of the locking plunger 130 out of engagement with the notch 77 of the output ring gear 76. The output ring gear 76 thus free wheels as the cable is manually pulled off of the cable drum 56.

Fixed to the shaft 252 of the clutch actuator 122 is a lateral member 254 having a hole 255 formed therein. As noted above, the pin 228 of the link 128 fits in the hole 255 of the lateral member 254. Formed on the underside of the lateral member is a rib 256 having on one side thereof a vertical surface 258 (FIG. 12*c*), and on an opposite side thereof a beveled or angled surface 260. When the engaging plate 88 (FIG. 8) rotates in one direction, the plunger pin 202 protruding from the engaging plate 88 abuts with the vertical surface 258 of the clutch actuator 122 and rotates the actuator 122 about its shaft 252 somewhat to automatically engage the clutch mechanism 75. The rotation of the clutch actuator 122 occasioned by engagement with the plunger pin 202 in the engaging plate 88 causes the link 128 to move back to a rest position, thus moving the block 240 of the locking plunger 130 back into engagement with the notch 77 of the output ring gear 76. When the engaging plate 88 is rotated in the opposite direction, the plunger pin 202 engages the beveled surface 260 of the locking plunger 130, whereupon the plunger pin 202 simply recedes under spring pressure into the engaging plate 88 and the clutch actuator 122 is not rotated or otherwise moved. In this instance, the link 128 and thus the locking plunger 130 are not moved, and the clutch mechanism 75 remains disengaged.

Figure 13A:
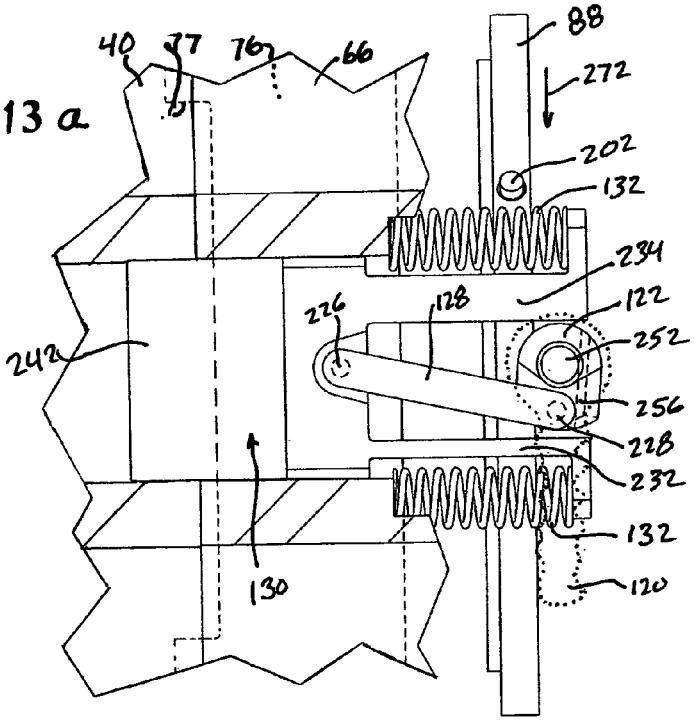
FIGS. 13*a* and 13*b* illustrate in simplified form the relative positions of the clutch components in respective engaged and disengaged positions.

The various views of FIGS. 13*a*-13*b* and 14*a*-14*c* illustrate the clutch mechanism 75 adapted for use with a winch 50. FIGS. 13*b* and 14*a*-14*c* show the clutch components in a disengaged condition in which the cable drum 56 is disconnected from the motor 52 so that the cable can be easily played out. FIG. 13*a* illustrates the components of the clutch in an engaged position. The handle 120 is fastened to the shaft 252 of the actuator 122. By manually turning the handle 120 from a rest position aligned with the general axis of the winch cable drum 56, the clutch mechanism 75 can be engaged to connect the motor 52 to the cable drum 56. The pin 228 of the link 128 fits in the hole 255 formed in the clutch actuator 122 and forms a hinged connection. The other end of the link 128 is similarly hinged to the locking plunger 130 by a pin 226 and hole 230 arrangement. Thus, as the handle 120 of the clutch mechanism 75 is rotated back and forth, the locking plunger 130 moves laterally in and out of engagement with the notch 77 of the output ring gear 76.

Figure 13B:
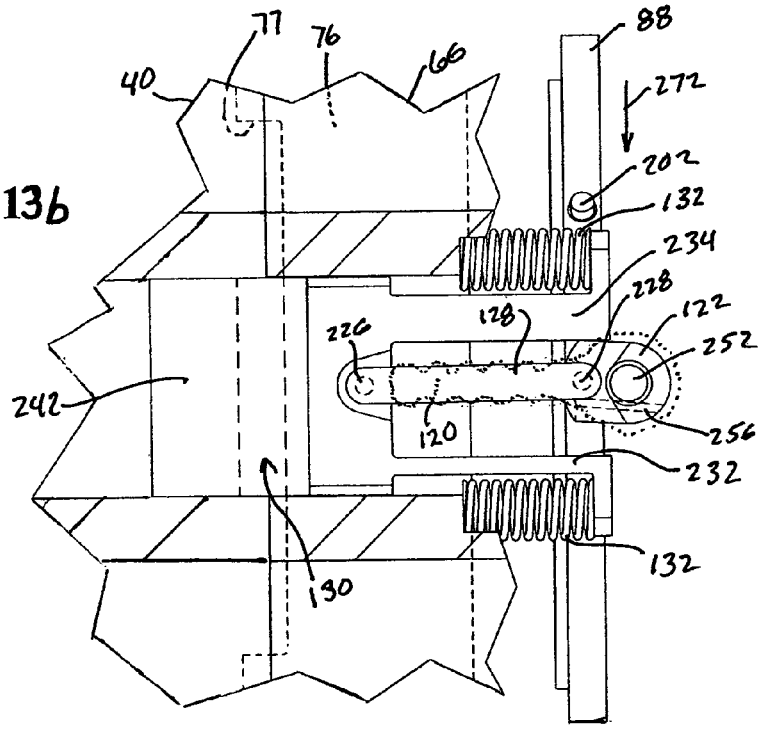

The clutch actuator 122 illustrated in FIG. 13*b* is shown when the handle 120 is rotated to the disengaged position. In such a position, the lateral member 254 of the clutch actuator 122 is rotated clockwise from the rest position to force the link 128 outwardly and thus move the locking plunger 130 outwardly (to the left in the drawing). This action causes the pair of springs 132 to be compressed between the out-turned ends 236 and 238 of the locking plunger 130 and the main gear housing 66. According to an important feature of the invention, the hinged connection between the clutch actuator 122 and the link 128 is moved slightly over center to a stable position in which the clutch mechanism 75 is disengaged. In the over-center position, the clutch actuator 122 abuts against the inside surface of the locking plunger leg 234, and is maintained in such position by spring pressure. The magnitude of the over center position may be less than 5 degrees, and preferably 1-2 degrees. The angle is so slight that is not discernable from the relative positions of the clutch actuator 122 and the link 128 shown in FIG. 13*b*. In any event, when the clutch actuator 122 and the link 128 are manually moved to the over-center position, the various clutch components are moved so that the locking plunger 130 is moved out of engagement with the notch 77 of the output ring gear 76. The output ring gear 76 is thus free to rotate with the planet gears of the output planetary gear stage 70.

While not shown, the output carrier 78 of the output planetary gear stage 70 is coupled to the slots 62 of the cable drum hub via a set of lugs. Thus, when the output ring gear 76 is disengaged from its fixed position, it is free to rotate with the cable drum 56 via the output planet gears and associated output carrier 78. Accordingly, if the user of the winch wishes to pull the cable off the cable drum 56, the cable drum 56 is rotated as are the various gears of the output planetary gear stage 70. The planet gears 80 of the output planetary gear stage 70 effectively rotate around the output sun gear 82 which remains stationary, as do the gears of the intermediate and input planetary gear stages 72 and 74. It is understood that when playing the cable out from the cable drum 56, the motor 52 is not energized.

In the event that the operator of the winch 50 desires to operate the winch 50 to wind the cable back onto the cable drum 56, all that is required is to start the motor 52. This can be accomplished either by pushing a switch on the winch, or preferably by wireless remote control. When the motor 52 is operated in a direction to wind the cable onto the cable drum 56, the input and intermediate planetary gear assemblies are driven accordingly. When the intermediate gear carrier engaging plate 88 (FIG. 8) is rotated by the motor 52 via the hex shaft 58, it rotates in the direction of arrow 272 of FIGS. 13*a*, 13*b* and 14*b*. The plunger pin 202 protruding from the intermediate carrier engaging plate 88 strikes the vertical surface 258 of the clutch actuator 122 and causes counterclockwise rotation (FIG. 13*b*) of the actuator 122 about the vertical shaft 252. The automatic counterclockwise rotation of the actuator 122 on energization of the motor 52 moves the hinged connection between the link 128 and the actuator 122 back from its over-center position, thereby allowing the springs 132 to drive the clutch actuator 122 to its fullest counterclockwise rest position, as shown in FIG. 13*a*. As such, the handle 120 is returned to its rest position and the clutch is engaged to allow the motor 52 to rotate the cable drum 56.

When the clutch actuator 122 is driven to its rest position by the springs 132, the link 128 moves laterally to the right in FIG. 13*a* and carries with it the locking plunger 130. The clutch actuator 122 is maintained in its rest position as the locking plunger 130 abuts against the output ring gear 76. The movement of the locking plunger 130 to the right is in a direction toward the output ring gear 76. In particular, the locking plunger 130 will become engaged in one of the notches 77 of the output ring gear 76, thus arresting rotational movement thereof and returning the winch clutch 75 to its engaged condition. It is noted that the clutch mechanism 75 is self engaged in response to the rotation of the motor 52 without manual engagement by the operator. However, in the event that the operator desires to manually engage the clutch mechanism 75, the only action required is the rotation of the handle 120 counterclockwise, so that the handle 120 is generally orthogonal to the axis of the cable drum 56, as shown in FIG. 13*a*.

With reference yet to FIG. 14*b*, in the event the clutch mechanism 75 is disengaged, and if the motor 52 is rotated in a direction that causes rotation of the intermediate carrier engaging plate 88 in a direction opposite that shown by arrow 272, then the plunger pin 202 merely strikes the beveled edge 260 of the clutch actuator 122. In doing so, the plunger pin 202 is forced downwardly into the bore of the intermediate carrier engaging plate 88, thus compressing the spring 200. The depressed plunger pin 202 then passes under the rib 256 of the clutch actuator 122, and the clutch mechanism 75 remains in the disengaged condition. When the clutch mechanism 75 is engaged, rotation of the motor 52 in a direction opposite arrow 272 will indeed rotate the cable drum 56 in a direction to unwind cable therefrom.

Figure 15A:
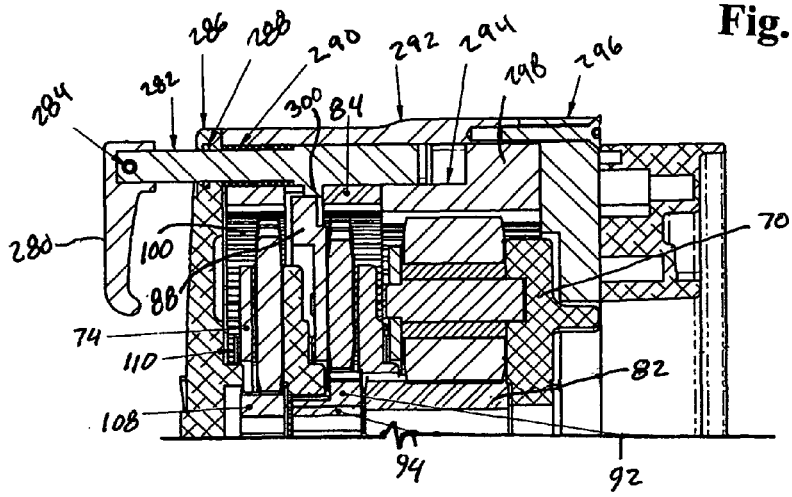
FIGS. 15*a*-15*c* are respective partial cross-sectional view, exploded view and cross-sectional view of another embodiment of a self-engaging clutch for use with a machine.
Figure 15B:
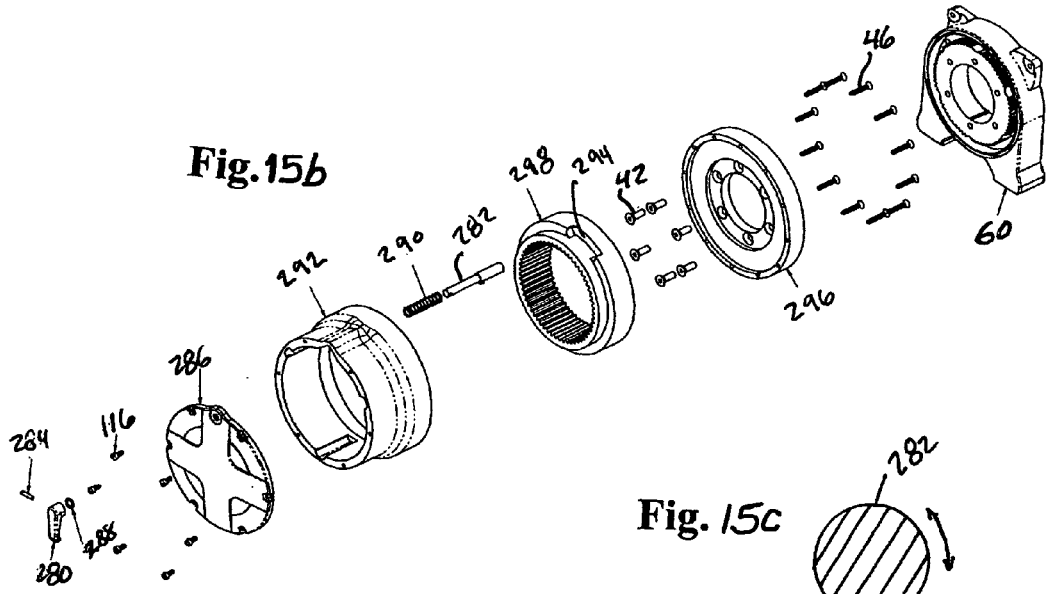
Figure 15C:
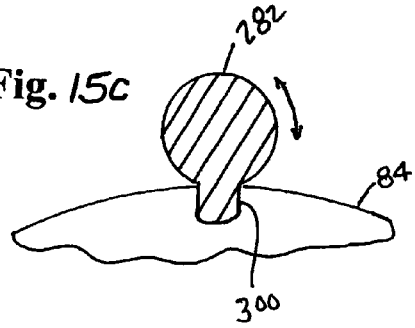

In accordance with yet another embodiment of the invention, there is illustrated in FIGS. 15*a*-15*c* a manually engaging and self-engaging clutch well adapted for use in a winch. In this embodiment, the clutch can be engaged on commencement of operation of the winch motor in either direction, e.g., to wind or unwind the cable from the cable drum 56. The winch shown in FIGS. 15*a*-15*c* employs the same three-stage planetary gear assembly as the winch described above. The winch of the alternate embodiment includes a handle 280 fastened to a plunger rod 282 by a pin 284. The plunger rod 282 extends through a hole in the gear housing cover 286. The plunger rod 282 is mounted for both rotation and axial movement. An O-ring 288 provides a seal between the plunger rod 282 and the gear housing cover 286. A spring 290 is compressed between an annular shoulder of the plunger rod 282 and the gear housing cover 286. The plunger rod 282 has a tab 300 formed on its underside, as shown in FIG. 15*c*. The tab 300 serves two purposes. First, when the plunger rod 282 is pulled by the handle 280 against the pressure of the spring 290 and turned so that the handle 280 is oriented downwardly, (as shown in FIG. 15*a*), the tab 300 is engaged behind the intermediate ring gear 84 (FIG. 15*c*). In this position, the inside end of the plunger rod 282 is removed from engagement with a notch 294 of the output ring gear 298, and the clutch is disengaged. The plunger rod 282 cannot slide axially inwardly, as the tab 300 abuts against the edge of the intermediate ring gear 84.

The clutch remains in the disengaged condition until the motor 52 of the winch is operated in either direction. To that end, the engaging plate 88 includes one or more pins (not shown) fixed on the peripheral edge thereof that strike the tab 300 of the plunger rod 282 during commencement of operation of the winch. Instead of employing spring loaded pins 202 described in connection with the engaging plate 88 shown in FIG. 8, the clutch of this embodiment need only use fixed pins. When a fixed pin strikes the tab 300 from either direction, the plunger rod 282 is caused to rotate so that the tab 300 then clears the edge of the intermediate ring gear 84, whereupon the spring 290 forces the plunger pin 282 back into engagement with the notch 294 of the output ring gear 298. The engagement of the inner end of the plunger rod 282 in the notch 294 of the output ring gear 298 engages the clutch and thus prevents rotation of the output ring gear 298 until again disengaged by the manual operation of the clutch handle 280.

Figure 16A:
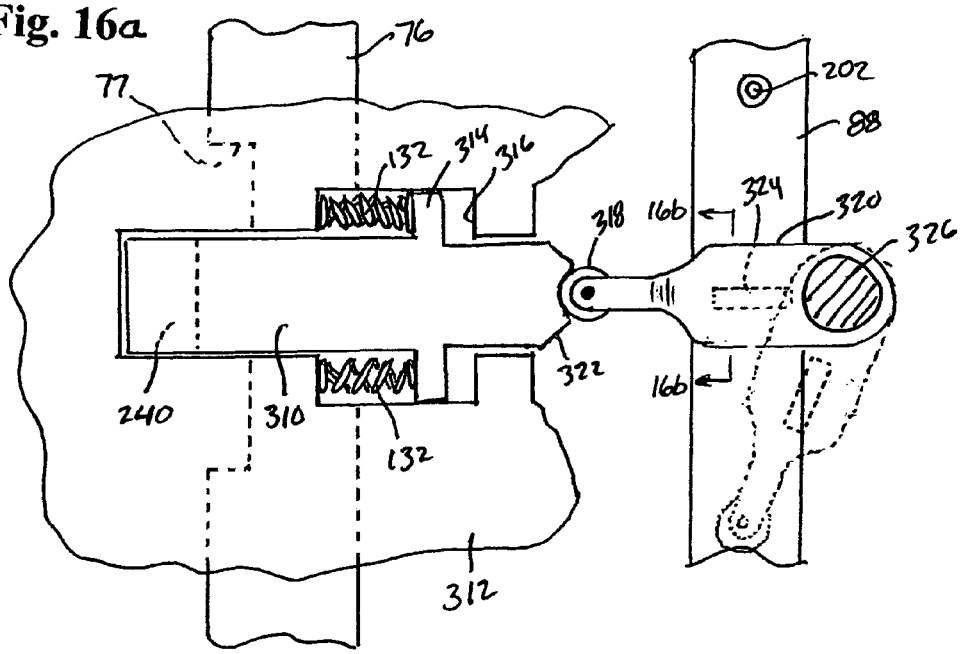
FIGS. 16*a* and 16*b* are respective top and partial cross-sectional views of yet another embodiment of a self-engaging clutch for use with a machine.
Figure 16B:
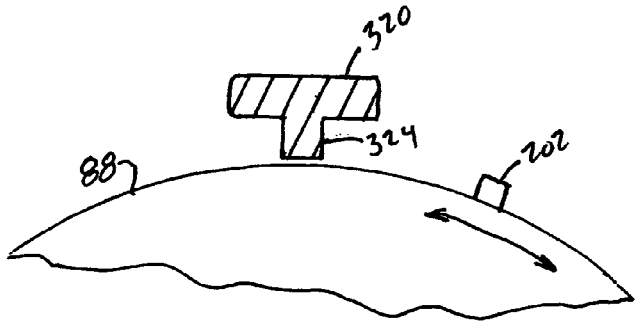

Illustrated in FIGS. 16*a* and 16*b* is another embodiment of a self-engaging clutch shown in simplified form. An output ring gear 76 with one or more notches 77 is employed, as described in the foregoing embodiments. A locking plunger 310 with a block 240 is laterally slidable in the main gear housing 312. The locking plunger 310 is biased with springs 132 so that the block 240 is engaged within the notch 77 of the output ring gear 76. Ears 314 formed on the locking plunger 310 engage against respective stops 316 when the clutch is engaged and the locking plunger 310 is in a rest position.

The end of the locking plunger 310 has formed therein a concave portion for receiving a roller 318 mounted in the end of a clutch actuator 320. When the clutch actuator 320 is rotated by a handle (not shown) in a clockwise direction (with respect to FIG. 16*a*), the roller 318 engages the camming surface 322 of the locking plunger 310 to move it, and then rolls into the concave rest formed in the end of the locking plunger 310. This action moves the locking plunger 310 to the left so that the block 240 is removed from engagement within the notch 77 of the output ring gear 76. The clutch is thus manually disengaged and remains in such condition until the motor 52 is energized in either a forward or reverse direction.

The operation of the motor 52 causes the engaging plate 88 to rotate in one direction or the other, whereby the pin 202 therein strikes a tab 324 formed on the underside of the clutch actuator 320. When the pin 202 strikes the tab 324, as shown in FIG. 16*b*, the clutch actuator 320 will be rotated about the vertical shaft 326 to which it is fixed. The rotation of the clutch actuator 320 dislodges the roller 318 from the concave rest of the locking plunger 310 and thus allows the locking plunger 310 to move back to its rest position under spring tension where the block 240 becomes engaged within the notch 77 of the output ring gear 76. The clutch is thus self engaged upon operation of the motor 52. It is noted that the operation of the motor 52 will cause the various gears of the output planetary gear stage 70 to rotate and cause rotation of the output ring gear 76 until the notch 77 is aligned with the block 240 of the locking plunger 31, whereupon the components become engaged.

It is noted that the end of the locking plunger 310 has a camming surface 322 on both sides thereof to allow the clockwise or counterclockwise movement of the clutch handle (not shown) to cause engagement of the roller 318 within the concave rest of the locking plunger 310. In addition, the rotation by the motor 52 of the engaging plate 88 in either direction will cause dislodgment of the roller 318 from the concave rest of the locking plunger 130. The clutch handle (not shown) can be spring biased to a rest position, or can be equipped with a ball and detent mechanism to maintain the handle in two stable positions of clutch engagement.

While the preferred embodiment of the invention involves a motor-driven winch, the principles and concepts of the invention can be use with a hand-driven winch or hoist. Also, while the concept of using a clutch actuator and over-center link mechanism is preferred, those skilled in the art may find that other clutch mechanisms can be used with equal effectiveness. Indeed, cam-operated mechanisms such as disclosed, and others, can be employed in lieu of the linkage described above. A variation of a winch within the scope of the invention may include a clutch link adapted to become wedged against a ring gear when the clutch is manually disengaged, and when the winch motor is operated, movement of the planetary gear train apparatus dislodges the link from its wedged condition to thereby self engage the clutch. The principles and concepts of the invention are applicable to machines other than winches and with machines employing apparatus other than planetary gears. Many other variations and applications are available for use of the invention therein.

While the preferred and other embodiments of the invention have been disclosed with reference to specific structures, it is to be understood that many changes in detail may be made as a matter of engineering choices without departing from the spirit and scope of the invention, as defined by the appended claims.

What is claimed is:

1. A clutch for use with a winch of the type having a drum on which a cable is wound and unwound, comprising:

a drive shaft adapted for powering the winch;

a housing in which clutch components are contained;

a clutch mechanism having a locking plunger moveable to a first position for allowing torque to be coupled from said drive shaft to said cable drum, and movable to a second position for allowing said cable drum to free wheel;

an actuator manually movable from a rest position in which the clutch mechanism is engaged to an actuated position in which the clutch mechanism is disengaged, said actuator connected to said to locking plunger so that when said actuator is in the rest position said locking plunger allows torque to be coupled to said cable drum, thereby allowing the drive shaft to drive the cable drum, and when said actuator is moved to said actuated position the cable drum is disconnected from said drive shaft and can be free wheeled; and a striking member rotatable by said drive shaft, said striking member engageable with said actuator to move the actuator from the actuated position to the rest position to thereby automatically engage said clutch mechanism when the drive shaft is rotated.

2. The self-engaging clutch of claim 1, further including a link hingeably connecting said locking plunger to said actuator, said link moveable by said actuator to an over-center position to maintain the locking plunger in said second position.

3. The self-engaging clutch of claim 1, wherein said actuator comprises a shaft which is spring biased to said first position, and said actuator is manually moveable in an axial direction to said second position.

4. The self-engaging clutch of claim 3, wherein said actuator includes a radial tab formed thereon, said tab responsive to striking thereof for rotating said actuator, whereupon a spring moves said actuator to said first position.

5. The self-engaging clutch of claim 3, wherein said striking member is a pin located on a periphery of a planetary gear carrier.

6. The self-engaging clutch of claim 5, wherein said pin is spring loaded.

7. A clutch for use with a winch of the type having a drum on which a cable is wound and unwound, comprising:

a housing for housing said clutch;

an input shaft driven by a motor;

a cable drum;

at least one planetary gear stage coupling torque from said input shaft to said cable drum, said planetary gear stage having a sun gear, plural planetary gears and a carrier for supporting said planetary gears, a ring gear mounted for rotation, said planetary gears meshing with said ring gear;

a clutch mechanism for coupling torque from said planetary gear stage to said cable drum and for disconnecting the planetary gear stage from said cable drum, said clutch mechanism including:

an actuator having a shaft connected to a handle, said actuator manually operable from a rest position to a second position for disengaging said clutch, said actuator having a lug off center from an axis of said handle shaft;

a locking member adapted for movement into engagement with said ring gear to lock said ring gear with respect to said housing, and out of engagement with said ring gear to allow said ring gear to rotate with said planetary gear stage;

a hinged link connecting said actuator to said locking member, said link and said actuator movable to an over-center condition when said actuator is in said second position; and a rotating member rotatable when said motor is energized, said rotating member adapted for striking said actuator lug to rotate said actuator and move said locking member into engagement with said ring gear.

* * * * *